US005659848A

United States Patent [19]

Jeon

[11] Patent Number: 5,659,848

[45] Date of Patent: Aug. 19, 1997

[54] HEAT ROLLER DEVICE

[75] Inventor: Nam-Gon Jeon, Seoul, Rep. of Korea

[73] Assignee: SamSung Electronics Co., Ltd., Suwon, Rep. of Korea

[21] Appl. No.: 657,764

[22] Filed: May 31, 1996

[30] Foreign Application Priority Data

May 31, 1995 [KR] Rep. of Korea ..... 12113/1995

[51] Int. Cl.[6] ..... G03G 15/20

[52] U.S. Cl. ..... 399/122; 384/275; 384/420; 384/539; 399/330

[58] Field of Search ..... 355/282, 285; 384/275, 420, 539; 492/47; 399/122, 330

[56] References Cited

U.S. PATENT DOCUMENTS

| | | | |
|---|---|---|---|
| 4,046,436 | 9/1977 | Brown | 384/420 X |
| 4,942,434 | 7/1990 | Nakai et al. | 355/290 |
| 5,070,366 | 12/1991 | Tsuchiya | 355/219 |
| 5,221,947 | 6/1993 | Ndebi et al. | 355/285 |
| 5,287,156 | 2/1994 | Shikada et al. | 355/285 |
| 5,293,202 | 3/1994 | Adachi et al. | 355/282 |
| 5,461,464 | 10/1995 | Swain | 355/211 |
| 5,485,260 | 1/1996 | Mitsuya | 355/290 |

*Primary Examiner*—Nestor R. Ramirez
*Attorney, Agent, or Firm*—Robert E. Bushnell, Esq.

[57] ABSTRACT

A heat roller device includes a frame, a hollow cylindrical fixing roller accommodating therein a heat source for fixing a toner image on a recording medium; a driving gear for driving the fixing roller; a first flange shaped bearing having a base attached to the frame and a projection extending from the base in order to accommodate the driving gear, for rotatably supporting one end of the fixing roller; and a second flange shaped bearing having a base attached to the frame, a projection extending from said base and a pair of hooks integrally extending from the projection for preventing movement of the fixing roller in its longitudinal axis, when the fixing roller is driven by the driving gear.

20 Claims, 3 Drawing Sheets

HEAT ROLLER DEVICE

This application makes reference to, incorporates the same herein, and claims all benefits accruing under 35 U.S.C. §119 from an application for Heat Roller Device earlier filed in the Korean Industrial Property Office on 31 May 1995, and there duly assigned Ser. No. 12113/1995.

BACKGROUND OF THE INVENTION

1. Technical Field

The present invention relates to a fixing device for fixing an image on a recording medium used in an image forming apparatus, and more particularly, to a heat roller mechanism for locking movement of a heat roller when the heat roller is rotated by a driving gear to fix a toner image on the recording medium.

2. Background Art

In an image forming apparatus such as, for example, a copier, a printer, an a facsimile machine etc., using an electrophotographic process, a latent image formed on a photosensitive drum is developed by applying toner from a developing unit onto the photosensitive drum. The toner image is then transferred and fixed on a recording medium. When a toner image is fixed on a recording medium, the toner image is first heated and fused onto the recording medium, and then naturally cooled so that it is fixed onto the recording medium.

In a conventional fixing device used for fixing an image on a recording medium as described, for example, in U.S. Pat. No. 5,485,260 for Fixing Device, Fixing Method, And Recording Apparatus issued to Mitsuya, U.S. Pat. No. 5,293,202 for Image Fixing Apparatus issued to Adachi et al., and U.S. Pat. No. 5,221,947 for Internally Heated Roller Assembly For Toner Image Fixing Apparatus issued to Ndebi et al., a pair of coactive fixing rollers consisted of one heat roller and one support roller is extensively used. The heat roller is typically heated to bring the pair of coactive rollers into contact with each other, thereby forming a nipping and fusing section. The recording medium is passed through this nipping and fusing section to fix the toner aligned thereon. When the recording medium is passed through the nipping and fusing section, the aligned toner which forms an image on the recording medium is heated and at the same time subjected to pressure. The heat energy and pressure applied at the nipping and fusing section changes the shape of the toner. This action causes the toner to be fixed onto the recording medium.

The heat roller is usually a hollow cylinder made of aluminum and has a heater at its central section. The aluminum hollow cylinder is called a core metal. A halogen lamp is often used for the heater. The support roller, on the other hand, has an elastic layer formed along the outer periphery of its metallic rotating body as described, for example, in U.S. Pat. No. 4,942,434 for Fixed Roller For An Electrostatic Image Recorder issued to Nakai et al. When it is pressed in contact with the heat roller, the elastic layer changes shape to form a nipping and fusing section. The heat roller of the conventional fixing device is typically supported by opposite end cylindrical bearings including a projection attached to an internal base of the frame of the fixing device. Conventional bearings are configured to prevent abrasion to the heat roller. A typical example of such conventional bearings is shown in Adachi et al. '202. Another bearing configuration is described in U.S. Pat. No. 5,287,156 for Fixing Device Capable Of Separating An End Portion Of A Recording Material By A Bearing issued to Shikada et al., in which fixing roller bearings are constructed, in lieu of a separation guide, to separate a recording medium from the surface of the heat roller in order to eliminate separation failure and damage to the surface of the heat roller. In addition to the opposite end cylindrical bearings as shown for example in Adachi et al. '202, stoppers in a form of a C-ring, as I have noted, are necessarily required to limit movement of the heat roller in its longitudinal direction in order to ensure that a toner image is cleanly fixed on a recording medium. The requirement of the pair of stoppers in addition to the bearings is however unproductive. I have also observed that the installation of such stoppers in the fixing roller assembly requires not only additional production cost but also consumes valuable assembly time both of which are highly undesirable in a production environment.

SUMMARY OF THE INVENTION

Accordingly, it is therefore an object of the present invention to provide an improved heat roller assembly of an image fixing device for use in an image forming apparatus.

It is also an object of the present invention to provide an improved and cost effective heat roller assembly for an image fixing device capable of fling a toner image on a recording medium cleanly.

It is another object of the present invention to provide an improved heat roller assembly in which production cost and assembly time are minimized.

It is further an object of the present invention to provide an improved heat roller assembly in which movement of a heat roller is contained in its longitudinal axis when driven by a driving gear without using a pair of conventional stoppers to ensure that a toner image is accurately fixed on a recording medium.

It is yet another object of the invention to provide an improved heat roller assembly in which movement of a heat roller is contained in its longitudinal axis when driven by a driving gear by an end bearing construction attached to a frame of a fixing device and having a hook for securing therein a heat lamp holder.

These and other objects of the present invention can be achieved by a heat roller assembly of an image fixing device constructed with a frame, and a fixing roller accommodating therein a heat source for fixing a toner image on a recording medium. The fixing roller includes an opening for enabling rotation of the fixing roller in response to a driving force. Driving gear having a protrusion is coupled to the opening of the fixing roller, for generating the driving force to rotate the fixing roller. A first cylindrical bearing having a base attached to the frame and a projection extending from the base is coupled to one end of the fixing roller for rotatably supporting the fixing roller. A second cylindrical bearing having a base attached to the frame, a projection extending from the base and a pair of hooks integrally extending in parallel from the projection is coupled to an opposite end of the fixing roller in order to prevent movement of the fixing roller in its longitudinal axis, when the fixing roller is rotated in response to application of the driving force.

The present invention is more specifically described in the following paragraphs by reference to the drawings attached only by way of example.

BRIEF DESCRIPTION OF THE DRAWINGS

A more complete appreciation of the present invention, and many of the attendant advantages thereof, will become readily apparent as the same becomes better understood by reference to the following detailed description when considered in conjunction with the accompanying drawings in which like reference symbols indicate the same or similar components, wherein.

DETAILED DESCRIPTION OF THE PREFERRED EMBODIMENT

Figure 1:
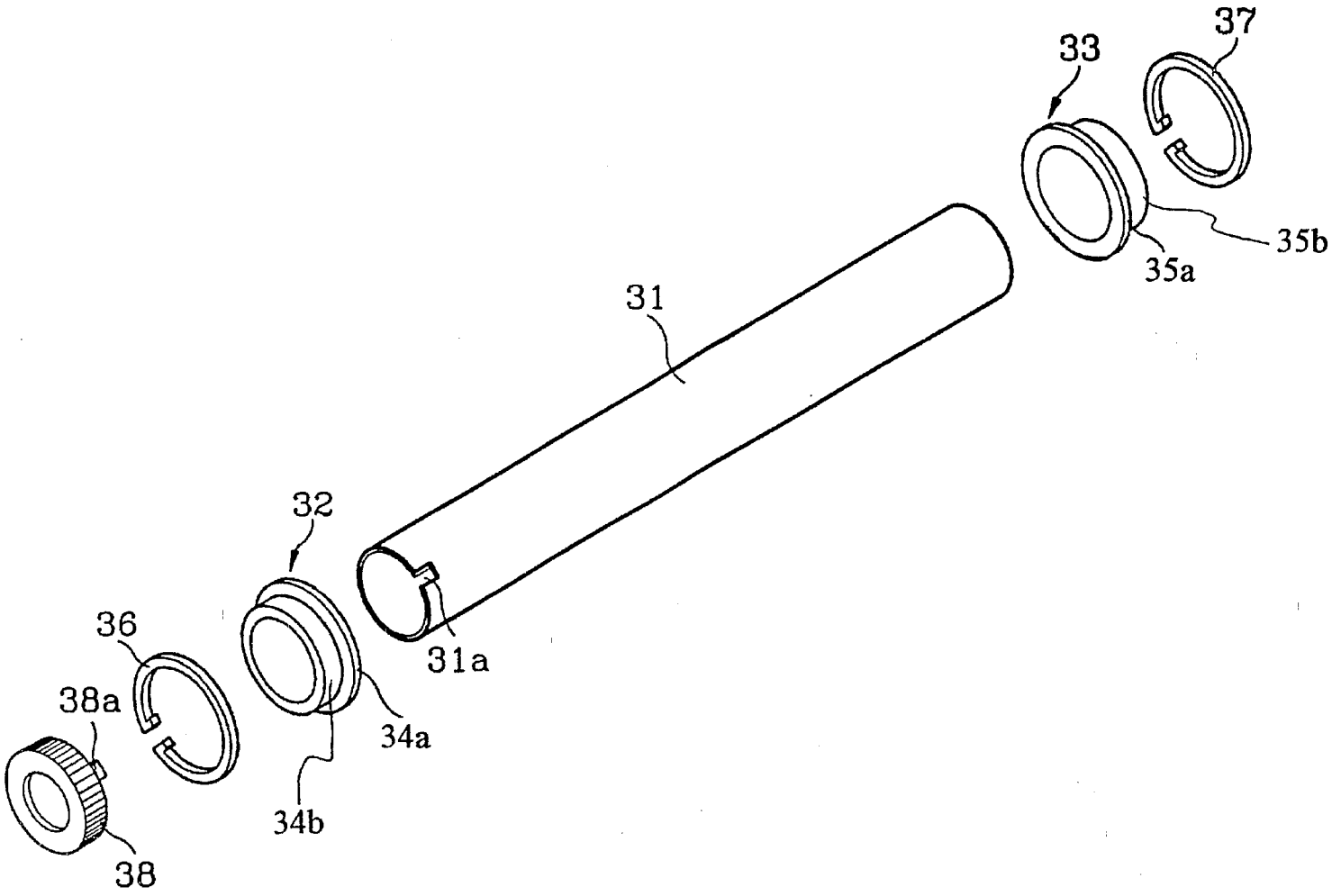
FIG. 1 illustrates, in the abstract, the salient features of a representation of a typical heat roller assembly of an image fixing device.

Referring now to the drawings and particularly to FIG. 1, which illustrates a typical heat roller assembly of an image fixing device. As shown in FIG. 1, the typical heat roller assembly includes a heat roller 31 having an opening 31*a* therein for accommodating a protrusion 38*a* of a driving gear 38, a pair of opposite end ranged bearings 32, 33 with each bearing having a base 34*a*, 35*a* and a projection 35*a*, 35*b* respectively, and a pair of C-rings 36 serving to prevent movement of the heat roller 31 in its longitudinal axis.

Figure 2:
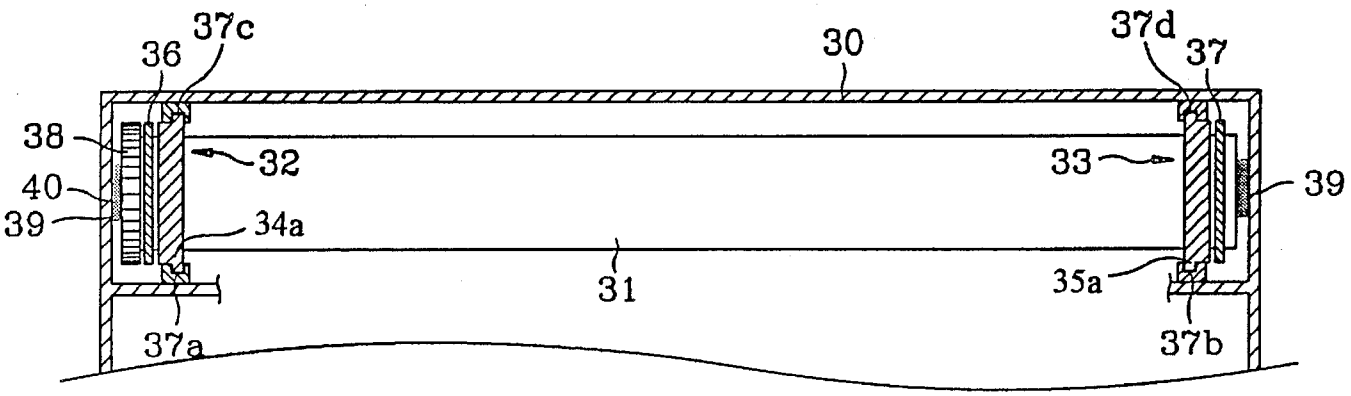
FIG. 2 illustrates a cross-sectional view of the typical heat roller assembly when mounted on a frame of an image fixing device.

FIG. 2 illustrates a cross-sectional view of the typical heat roller assembly when mounted on a frame of an image fixing device. Referring to FIGS. 1 and 2, the heat roller 31 is positioned in a cartridge (not shown) for fixing a toner image on a recording medium. A heat lamp 39 to radiate heat as a function of electric application is installed in an interior of the heat roller 31. An opening part 31*a* is formed at one end of the heat roller 31 for accommodating a protrusion 38*a* of a driving gear 38. A first bearing 32 is installed at one end of the heat roller 31 so as to prevent abrasion of the heat roller 31. The first bearing 32 has a base 34*a* and a first projection 34*b* extending from the base 34*a* for rotatably supporting the heat roller 31. The base 34*a* of the first bearing 32 is inserted into a first pair of grooves 37*a* and 37*c* of an upper frame 30, when the heat roller assembly is inserted into the cartridge.

The first bearing 32 has, on its one side, a first C-ring 36 installed to prevent the heat roller 31 from being moved or slid along its longitudinal axis, i.e., in the left or right direction. Next to the first C-ring 36 is the driving gear 38 assembled to rotate the heat roller 31 in response application of a driving force from a main motor (not shown). The driving gear 38 includes a projection 38*a* to be coupled with the opening part 31*a* of the heat roller 31.

Similarly, the second bearing 33 is installed at an opposite side of the heat roller 31 so as to prevent abrasion of the heat roller 31. The second bearing 33 also has a base 35*a*, and a projection 35*b* extending from the base 35*a* for rotatably supporting the heat roller 31. The base 35*a* of the second bearing 33 is inserted into a second pair of grooves 37*b* and 37*d* of an upper frame 30, when the heat roller assembly is inserted into the cartridge. The second bearing 33 has, on its one side, a second C-ring 37 installed to prevent the heat roller 31 from being moved or shifted in the leer or right direction of the horizontal axis of the heat roller 31.

After the assembly of the heat lamp 39 in the interior of the heat roller 31, the first bearing 32 is inserted in one side of the heat roller 31 and then the first C-ring 36 is fixedly secured into the heat roller 31. Thereafter, the projection 38*a* of the driving gear 38 is coupled with the opening part 31*a* of the heat roller 31. After the second bearing 33 is inserted into the other side of the heat roller 31, the second C-ring 37 is fixedly secured into the heat roller 31.

Then, the base 34*a* of the first bearing 32 coupled with one side of the heat roller 31 is assembled into first and third grooves 37*a* and 37*c* of the upper frame 30 of the toner fixing device. Similarly, the base 35*a* of the second bearing 33 coupled with the other side of the heat roller 31 is assembled into the second and fourth grooves 37*b* and 37*d* of the upper frame 30 of the toner fixing device, so that the heat roller 31 is fixedly secured in the upper frame 30 of the toner fixing device.

Meanwhile, if power supply is provided to the heat roller 31 through an electrical port 40, the temperature on the surface of the heat roller 31 is raised by the heat radiated from the heat lamp 39 and the toner image is fixed on the surface of the recording medium. After the toner image is fixed on the recording medium, the recording medium is ejected from the image forming apparatus to a stacker through a conveying roller.

As I have described earlier, the requirement of a pair of C-ring stoppers 36, 37 in addition to the bearings 32, 33 is however unproductive. Moreover, the installation of such C-ring stoppers in the fixing roller assembly requires not only additional production cost but also consumes valuable assembly time both of which are highly undesirable in a production environment.

Figure 3:
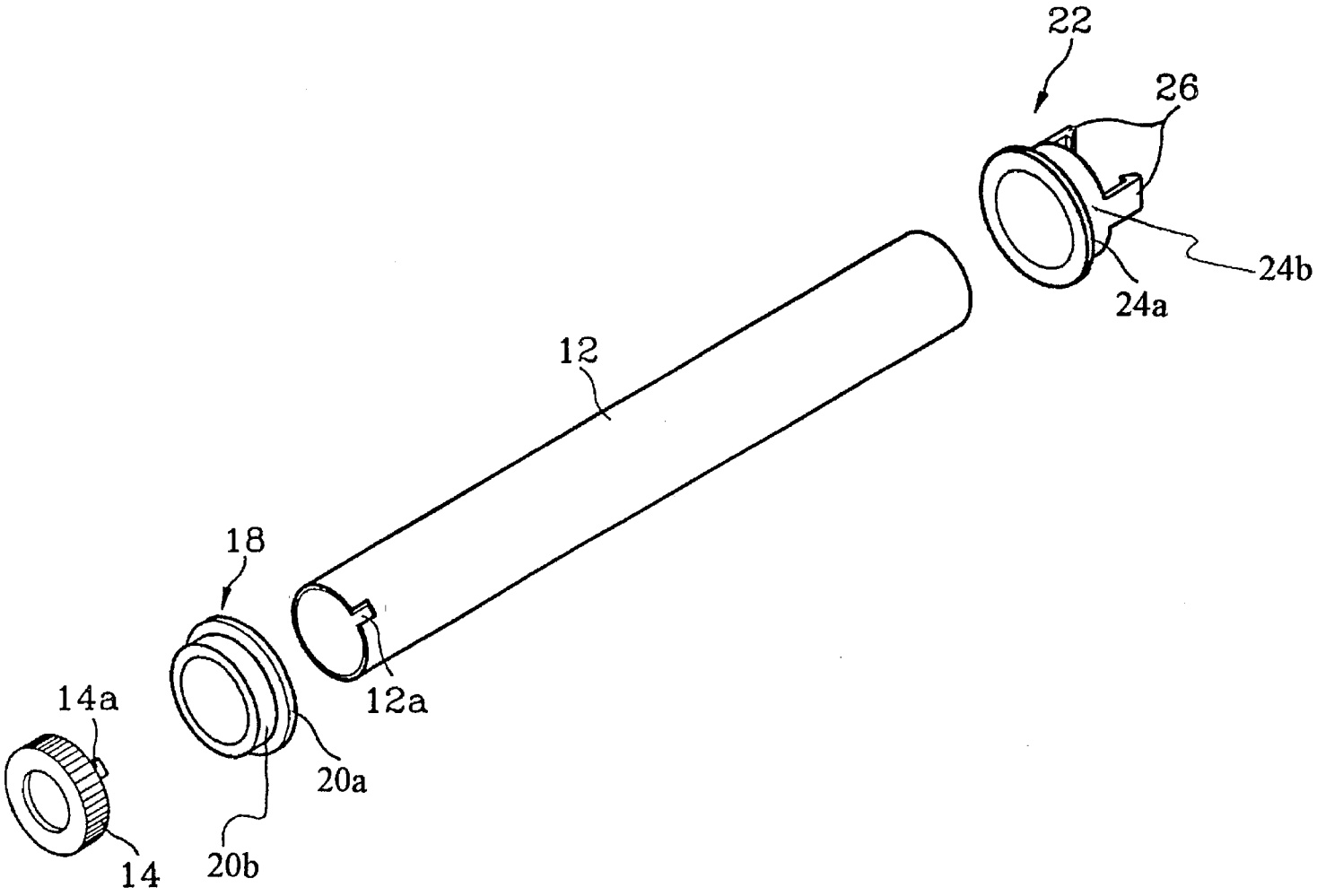
FIG. 3 illustrates an improved heat roller assembly constructed according to the principles of the present invention.

Turning now to FIG. 3 which illustrates an improved heat roller assembly constructed according to the principles of the present invention. As shown in FIG. 3, the heat roller assembly as contemplated by the present invention includes a heat roller 12 accommodating therein a heat source for fixing a toner image on a recording medium. A driving gear 14 including a projection 14*a* is connected to the heat roller 12 via an opening part 12*a* of the heat roller 12 for driving the heat roller 12. A first bearing 18 having a base 20*a* and a projection 20*b* extending from the base 20a is provided at one end of the heat roller 12 for rotatably supporting the heat roller 12. A second bearing 22 having a base 24*a*, a projection 24*b* extending from the base 24*a*, and a pair of hooks 26 integrally extending from the projection 24*b* is provided at an opposite end of the heat roller 12 for rotatably supporting the heat roller 12. The pair of hooks 12 is constructed as an integral part of the second bearing 22 for preventing movement of the heat roller 12 in its longitudinal axis, when the heat roller is driven by the driving gear 14.

The first and second bearings 18 and 22 are shaped in a form of a flange but are hollowed in their respective central body to accommodate an insertion of the heat roller 12. When the heat roller 12 is fully assembled and mounted on a frame of an image fixing device, the outer and circumferential diameter of the heat roller 12 is positioned inside the first and second bearings 18 and 22. The driving gear 14 is also hollowed with an interior base diameter for accommodating the outer and circumferential surface of the heat roller 12 when the heat roller 12 is inserted through the first bearing 12 and the driving gear 14, and a blocking surface at one side serving as a stopper for securing the heat roller 12 therein. At the outer side of the driving gear 14 is a projection 14*a* extending therefrom to lock into the opening part 12*a* of the heat roller 12 so that, when a driving force is applied from a main motor (not shown), the heat roller 12 can be rotated as the projection 14*a* of the driving gear 14 is driven.

Figure 4:
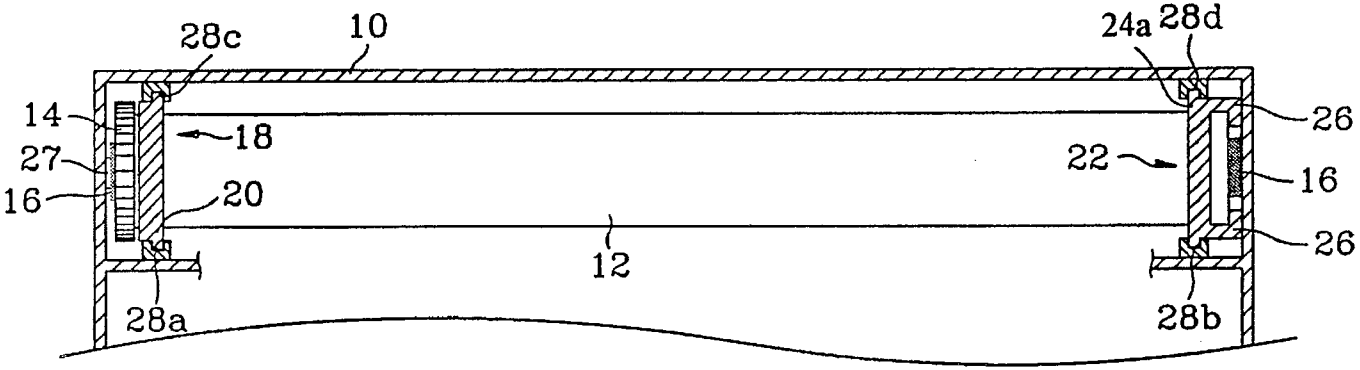
FIG. 4 illustrates a cross-sectional view of the improved heat roller assembly constructed according to the present invention when mounted on a frame of an image fixing device.

Referring now to FIG. 4 which illustrates a cross-sectional view of the improved heat roller assembly constructed according to the present invention when mounted on a frame of an image fixing device. As shown in FIGS. 3 and 4, a heat lamp 16 is installed in an interior of the heat roller 12 in a longitudinal direction to radiate heat depending upon an electric function. An opening part, or indent 12*a* having a "C" shape is formed at one end portion of the heat roller 12 in the right direction thereof so as to couple with the driving gear 14. The first bearing 18 is installed in one side of the heat roller 12 so as to prevent abrasion of the heat roller 12 during its rotation. The first bearing 18 has, on its outer side, a base 20*a* to be coupled with first and third grooves 28*a* and 28*c* of the upper frame 10 of the cartridge (not shown).

Next to the first bearing 18 is the driving gear 14 used to rotate the heat roller 12 by means of driving force of the main motor. The driving gear 14 has a projection 14*a* to be coupled with the opening part 12*a* formed in one end portion of the heat roller 12. The driving gear 14 as contemplated by the present invention can use a helical gear or a spur gear that generates thrust so that the heat roller 12 receives the driving force only in one direction.

The second bearing 22 is also installed at the other side of the heat roller 12 so as to prevent abrasion of the heat roller 12 during its rotation. The second bearing 22 has a base 24*a* to be inserted into the second and fourth grooves 28*b* and 28*d* of the upper frame 10 of the cartridge when the heat roller assembly is inserted into the cartridge.

In addition, the second bearing 22 is also constructed to include a pair of hooks, or detents 26 in a "L" shape extending in parallel from the projection 24*b* in a unitary structure. The pair of hooks 26 is designed to prevent the heat roller 12 from being moved or shifted in the left or right direction in its longitudinal axis, when the heat roller assembly is inserted into the cartridge.

The operations of the heat roller assembly constructed according to the principles of the present invention will be explained as follows. After assembly of the heat lamp 16 into the interior of the heat roller 12, the first bearing 18 is inserted in one side of the heat roller 12 and the projection 14*a* of the driving gear 14 is coupled with the opening part 12*a* formed in one end portion of the heat roller 12.

Then, the second bearing 22 is inserted into the other side of the heat roller 12. The interior of the hook 26 formed in the second bearing 22 is contacted with one side of the heat roller 12.

Thereafter, the base 20*a* of the first bearing 18 coupled with one side of the heat roller 12 is assembled into the first and third grooves 28*a* and 28*c* of the upper frame 10 of the toner fixing device. Similarly, the base 24*a* of the second bearing 22 coupled with the other side of the heat roller 12 is also assembled into the second and fourth grooves 28*b* and 28*d* of the upper frame 10 of the toner fixing device, so that the heat roller 12 can be fixedly secured in the upper frame 10 of the toner fixing device.

In the meantime, if power supply is provided to the heat roller 12 through an electric port 27, the temperature on the surface of the heat roller 12 is raised by the heat radiated from the heat lamp 16 and the toner image is fixed on surface of the recording medium. After the toner image is fixed on the recording medium, the recording medium is ejected from the image forming apparatus to a stacker through a conveying roller.

As mentioned above, the heat roller device of the present invention utilizes the hook formed in the second bearing without using the first C-ring and the second C-ring for preventing the movement of the heat roller in its longitudinal axis in order to reduce the production cost. Moreover, since the heat roller is fixedly secured by the hook, the heat roller is firmly secured in place and is not susceptible to being shifted in the left or right direction of its horizontal axis. Because of this improved configuration of the heat roller assembly, it is now possible to cleanly fix a toner image on the surface of the recording paper, and consequently, to form an image of high resolution. In addition, the time taken in assembling the heat roller is now reduced and the productivity is improved because of simplicity in the construction of the heat roller device.

While there have been illustrated and described what are considered to be preferred embodiments of the present invention, it will be understood by those skilled in the art that various changes and modifications may be made, and equivalents may be substituted for elements thereof without departing from the true scope of the present invention. In addition, many modifications may be made to adapt a particular situation to the teaching of the present invention without departing from the central scope thereof. Therefore, it is intended that the present invention not be limited to the particular embodiment disclosed as the best mode contemplated for carrying out the present invention, but that the present invention includes all embodiments falling within the scope of the appended claims.

What is claimed is:

1. An image fixing device, comprising:

a housing having first holding means for holding a first flange shaped bearing and second holding means for holding a second flange shaped bearing;

a hollow cylindrical fixing roller having an opening part at one end;

driving means having a protrusion fitted into the opening part of said hollow cylindrical fixing roller, for driving said hollow cylindrical fixing roller;

said first flange shaped bearing having a base which fits said first holding means of said housing; and said second flange shaped bearing having a base which fits said second holding means of said housing, and heat roller secure means which comprises a pair of hooks in a "L" shape integrally extending from the base in parallel from diametrically opposite side of said base for fixedly securing therebetween the hooks one side of said hollow cylindrical fixing roller to prevent axial movement of said hollow cylindrical fixing roller.

2. The image fixing device of claim 1, further comprised of said driving means corresponding to one of a helical gear and a spur gear for generating an unidirectional driving force to said hollow cylindrical fixing roller so that said hollow cylindrical fixing roller is driving in one direction.

3. An image fixing device, comprising:

a housing;

a hollow cylindrical fixing roller accommodating therein a heat source for fixing a toner image on a recording medium, said hollow cylindrical fixing roller having an opening part at one end;

driving means having a protrusion inserted into the opening part of said hollow cylindrical fixing roller, for driving said hollow cylindrical fixing roller;

a first flange shaped bearing having a base attached to said housing, for rotatably supporting one end of said hollow cylindrical fixing roller; and a second flange shaped bearing having a base attached to said housing, and a pair of hooks in a "L" shape integrally extending from the base in parallel from diametrically opposite side of said base for securing therebetween the hooks one side of said hollow cylindrical fixing roller.

4. The image fixing device of claim 3, further comprised of said housing having corresponding grooves for securely accommodating the base of said first and second flange shaped bearings at opposite ends of said hollow cylindrical fixing roller.

5. The image fixing device of claim 4, further comprised of said hooks serving as a stopper for preventing said fixing roller from shifting in its longitudinal axis, when said hollow cylindrical fixing roller is inserted into said housing.

6. The image fixing device of claim 3, further comprised of said housing having corresponding grooves for accommodating the base of said first and second flange shaped bearings at opposite ends of said hollow cylindrical fixing roller.

7. The image fixing device of claim 3, further comprised of said driving means generating an unidirectional driving force to said hollow cylindrical fixing roller so that said fixing roller is driven in one direction.

8. The image fixing device of claim 7, further comprised of said driving means corresponding to one of a helical gear and a spur gear for generating said unidirectional driving force.

9. The image fixing device of claim 7, further comprised of said first and second flange shaped bearings each being cylindrical and comprising said base inserted into corresponding grooves of said housing at diametrically opposing sides of said fixing roller.

10. An image fixing device, comprising:

a housing;

a fixing roller accommodating therein a heat source for fixing a toner image on a recording medium, said fixing roller having an opening for enabling rotation of said fixing roller in response to a driving force;

driving means having a protrusion coupled to said opening of said fixing roller, for generating said driving force to rotate said fixing roller;

a first cylindrical bearing having a base attached to said housing and a projection extending from said base accommodating said driving means, for slidably supporting one end of said fixing roller; and a second cylindrical bearing having a base attached to said housing, a projection extending from said base and means integrally extending from said projection, for slidably supporting an opposite end of said fixing roller and for preventing movement of said fixing roller, when said fixing roller is rotated in response to application of said driving force.

11. The image fixing device of claim 10, further comprised of said means integrally extending from said projection of said second flange shaped bearing corresponding to a pair of hooks extending in parallel from said projection for securing therein one side of said fixing roller.

12. The image fixing device of claim 11, further comprised of said hooks serving as an integrated stopper for preventing said fixing roller from moving in its longitudinal axis, when said fixing roller is inserted in said housing.

13. The image fixing device of claim 11, further comprised of said housing having corresponding grooves for securely accommodating the base of said first and second flange shaped bearings at opposite ends of said fixing roller.

14. The image fixing device of claim 11, further comprised of said driving means generating an unidirectional driving force to said fixing roller so that said fixing roller is driven in one direction.

15. The image fixing device of claim 14, further comprised of said driving means corresponding to one of a helical gear and a spur gear for generating said unidirectional driving force.

16. The image fixing device of claim 15, further comprised of said first cylindrical bearing comprising said base inserted into corresponding grooves of said housing at one side of said fixing roller.

17. The image fixing device of claim 16, further comprised of said second cylindrical bearing comprising said base inserted into corresponding grooves of said housing at an opposite side of said fixing roller.

18. The image fixing device of claim 11, further comprised of said means integrally extending from said projection of said second flange shaped bearing corresponding to a pair of detents in a "L" shape extending axially outwardly in parallel from diametrically opposite side of said projection with radially inwardly directed distal protrusions of said detents forming distal terminal portions of said "L" shape for securing between detents one side of said fixing roller.

19. An image fixing device, comprising:

a housing having a first secure mechanism and a second secure mechanism for securing a fixing roller assembly in said housing; said fixing roller assembly comprising:

a fixing roller having an opening part at one end;

driving means for driving said fixing roller, said driving means having a protrusion inserted into said opening part of said fixing roller for transferring a driving force to said fixing roller to rotate said fixing roller;

a first bearing having a base locked to said housing by said first secure mechanism;

a second bearing having a base locked to said housing by said second secure mechanism, and means integrally extending from said base, for slidably supporting an opposite end of said fixing roller and preventing axial movement of said fixing roller, when said fixing roller is rotated in response to application of said driving force.

20. The image fixing device of claim 19, further comprised of said means integrally extending from said base of said second bearing corresponding to a pair of detents in a "L" shape extending axially outwardly in parallel from diametrically opposite side of said base with radially inwardly directed distal protrusions of said detents forming distal terminal portions of said "L" shape for securing between detents one side of said fixing roller.

* * * * *